US006584625B2

(12) United States Patent
Weaver

(10) Patent No.: US 6,584,625 B2
(45) Date of Patent: Jul. 1, 2003

(54) DRAIN FLOW CONTROL DEVICE FOR COMMERCIAL DRAINAGE SYSTEM

(75) Inventor: Mark Weaver, Six Mile, SC (US)

(73) Assignee: T&S Brass and Bronze Works, Inc., Travelers Rest, SC (US)

( * ) Notice: Subject to any disclaimer, the term of this patent is extended or adjusted under 35 U.S.C. 154(b) by 0 days.

(21) Appl. No.: 10/024,979

(22) Filed: Dec. 19, 2001

(65) Prior Publication Data

US 2002/0194675 A1 Dec. 26, 2002

Related U.S. Application Data

(60) Provisional application No. 60/297,384, filed on Jun. 11, 2001, and provisional application No. 60/301,033, filed on Jun. 26, 2001.

(51) Int. Cl.[7] ..... E03C 1/23
(52) U.S. Cl. ..... 4/688; 251/127
(58) Field of Search ..... 4/688, 650, 653, 4/679, 287; 251/127

(56) References Cited

U.S. PATENT DOCUMENTS

| | | | | |
|---|---|---|---|---|
| 413,365 A | | 10/1889 | Gilcher | |
| 1,173,798 A | * | 2/1916 | Groom | 4/287 |
| 1,964,423 A | | 6/1934 | Blickman | |
| 1,974,419 A | | 9/1934 | Cornell, Jr. | |
| 2,580,575 A | | 1/1952 | Muckler | |
| 2,597,399 A | | 5/1952 | Steele | |
| 2,699,555 A | | 1/1955 | Green | |
| 4,161,965 A | * | 7/1979 | Merritt | |
| 4,457,030 A | * | 7/1984 | Burry | 4/688 |
| 5,546,614 A | * | 8/1996 | King, II | 4/256.1 |
| 6,058,526 A | | 5/2000 | Parisi et al. | |

FOREIGN PATENT DOCUMENTS

| | | | | |
|---|---|---|---|---|
| CH | 377746 | * | 6/1964 | 4/688 |
| DE | 1 194 789 | * | 6/1965 | 4/688 |

* cited by examiner

*Primary Examiner*—Charles R. Eloshway
(74) *Attorney, Agent, or Firm*—Dority & Manning, P.A.

(57) ABSTRACT

A fluid flow control device is provided as an integral component of a drainage system for sinks in a commercial environment. This fluid flow control device includes a housing that is disposed beneath a waste valve and configured to define a flow control insert that is configured and disposed to interrupt the flow of fluid leaving the waste valve and before that flow reaches a grease interceptor. Both the housing and flow control insert are desirably made as a unitary structure from cast metal. Alternatively, the housing can define a ledge that receives a removable disk forming the flow control insert. In both embodiments, the flow control insert that has an opening through the insert that is sized for a flow area according to the needs of the fluid flows that are anticipated in the drainage system in question.

9 Claims, 5 Drawing Sheets

DRAIN FLOW CONTROL DEVICE FOR COMMERCIAL DRAINAGE SYSTEM

CROSS-REFERENCE TO RELATED APPLICATIONS

The present application claims the benefit of priority to and is a continuation-in-part of application Ser. No. 60/297,384, filed Jun. 11, 2001, and is a continuation of application Ser. No. 60/301,033, filed Jun. 26, 2001.

STATEMENT REGARDING FEDERALLY SPONSORED RESEARCH OR DEVELOPMENT

Not applicable.

BACKGROUND OF THE INVENTION

The present invention pertains to a device for the control of fluid flow and in particular to such a device that can be used when originally installing a commercial drainage system or retrofitted onto an existing system.

Commercial kitchens such as those found in schools and restaurants are subject to environmental regulations that limit the amount of grease that can be introduced into the waste water from the sinks used in such kitchens. Typically, these regulations require the installation of grease interceptors downstream from drains, and these interceptors separate the grease from the waste water that drains from sinks in the kitchens. However, if the flow rate that enters the grease interceptors should exceed the capacity of the interceptor, the amount of grease deposited into the sewage system can exceed the amount allowable pursuant to the regulations. This can result in the assessment of fines or other penalties against the offending establishment. Moreover, such excessive flows of grease may have an adverse impact on the waste water/sewage treatment facilities that service the community.

OBJECTS AND SUMMARY OF THE INVENTION

It is a principal object of the present invention to provide an apparatus and method that prevents overloading the grease interceptors used in commercial kitchens.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a flow control device for a sink that drains into a system that includes a grease interceptor comprises a hollow housing defining an interior and an exterior and an axial opening extending the length of the interior of the housing, which has a first end and a second end disposed opposite the first end.

In a presently preferred embodiment, the housing is formed integrally as an extension to the outlet end of a waste valve. The housing and the body that defines the flow path of the waste valve constitute a unitary member. A flow control insert is disposed across the interior of the housing and defines a hole through the insert. The hole is sized such that the flow area through the hole is smaller than the flow area through the axial opening along the first end of said housing. In this presently preferred embodiment, the insert is integrally formed as a unitary member with the housing portion of the unitary unit.

In an alternative embodiment, the interior walls of the housing define a ledge disposed between the first end and the second end of the housing. A portion of the axial opening of the housing is defined by a threaded wall that extends from the first end to the ledge. The housing defines a threaded surface that begins at the second end on at least one of the exterior and the interior of the housing. A flow control insert defines a structure that is separate from the housing. The flow control insert is configured to be received in the housing and has a peripheral surface that is configured to rest against the ledge that is defined in the interior of the housing.

The accompanying drawings, which are incorporated in and constitute a part of this specification, illustrate one presently preferred embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
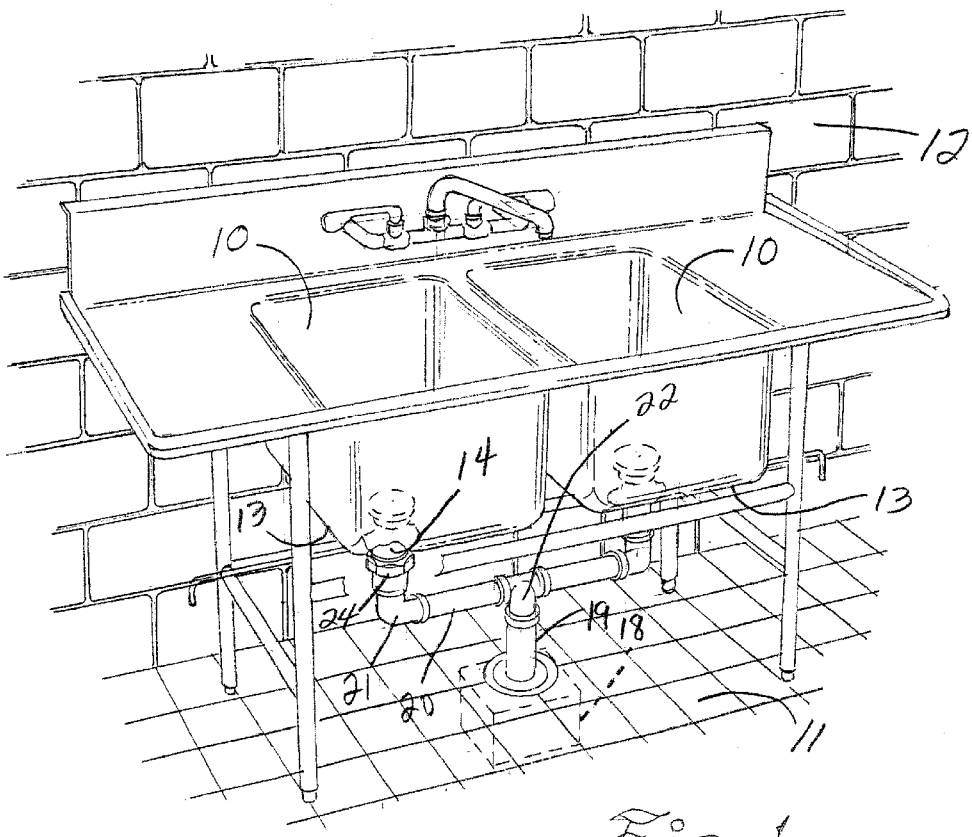
FIG. 1 is an elevated perspective view of an embodiment of the present invention installed in the environment in which the device is intended to be employed.

As shown in FIG. 1, a pair of sinks 10, each typically of stainless steel construction, is disposed in a commercial environment such as a restaurant or school kitchen and rests atop a floor 11 near a wall 12 thereof. Beneath the bottom 13 of each sink 10 is a drainage valve 14 (a.k.a. waste valve) that can be opened or closed via a handle 16. Typical examples of such valves 14 are disclosed in U.S. Pat. Nos. 6,058,526; 2,580,575; 1,974,419; 2,597,399; and 2,699,555; the disclosures of which are all hereby completely incorporated herein by this reference. Moreover, instead of a ball valve as in U.S. Pat. No. 6,058,526, a poppet valve can form the waste valve 14 and can be operated by a lever movement of the handle 16 or a twisting movement of the handle 16.

Figure 2:
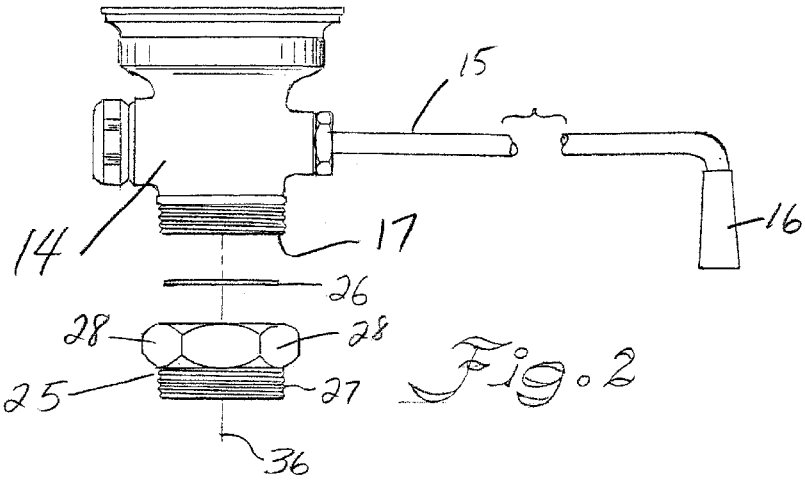
FIG. 2 is a side plan, assembly view of one alternative embodiment of the device of FIG. 1.

As schematically shown in FIG. 2, each of these waste valves 14 has an outlet end 17. As schematically shown in FIG. 1, a grease interceptor 18 is indicated schematically in phantom by the dashed lines and is shown to be disposed beneath the floor 11. The outlet end 17 of each of these waste valves 14 is connected in fluid communication with a grease interceptor 18. This can be accomplished by connecting the outlet end 17 of each waste valve 14 in fluid communication with a drain pipe 19 by a leader pipe 20 having on one end an elbow fitting 21 and threading into one port of a T-fitting 22 with the opposite end of the leader pipe 20.

Figure 5A:
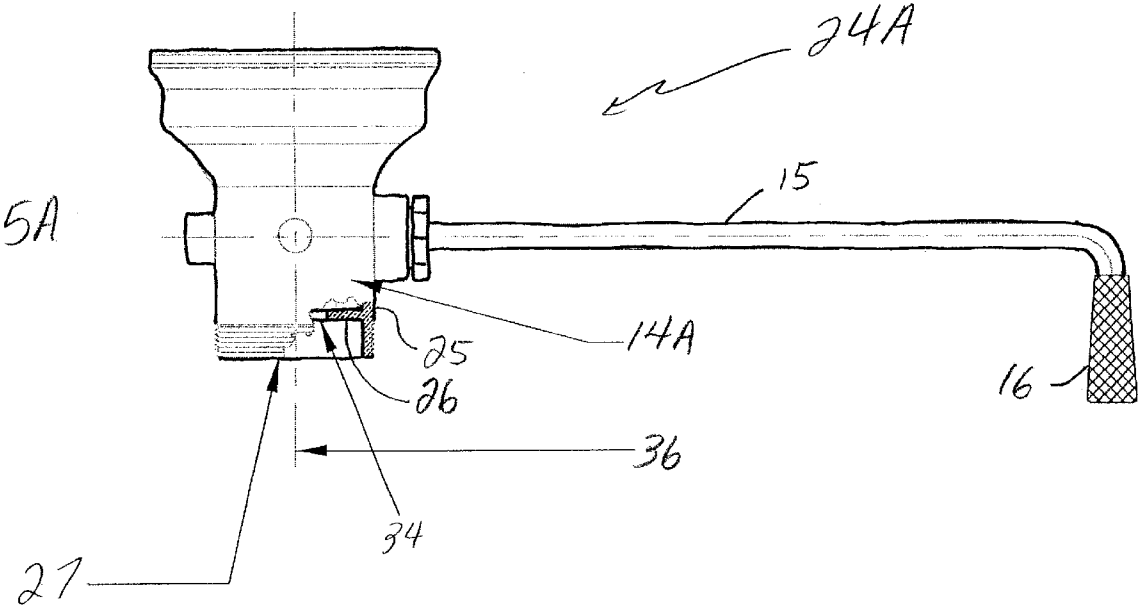
FIG. 5A is a side plan view of a presently preferred embodiment of the device of the present invention.
Figure 5B:
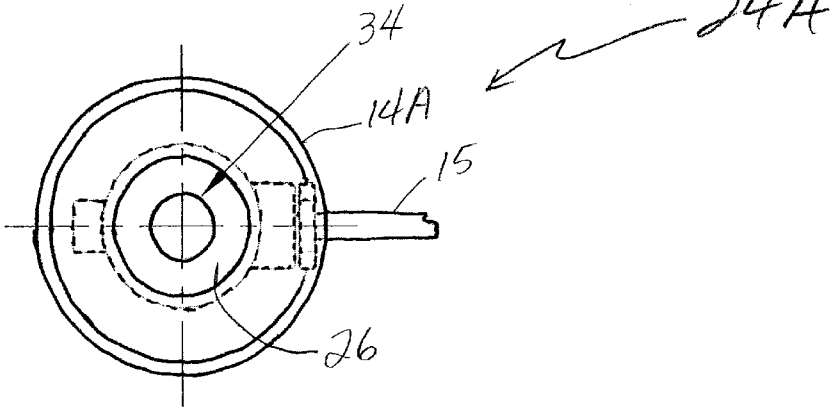
FIG. 5B is a top plan view of the embodiment shown in FIG. 5A with portions shown in phantom by the dashed lines.
Figure 6:
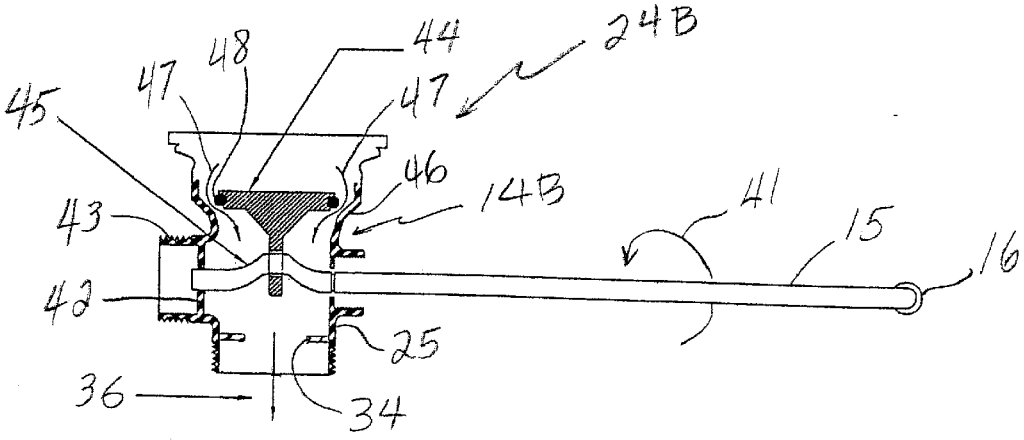
FIG. 6 is a cross-sectional view of an alternative preferred embodiment of the device of the present invention with the waste valve in the open position.
Figure 7:
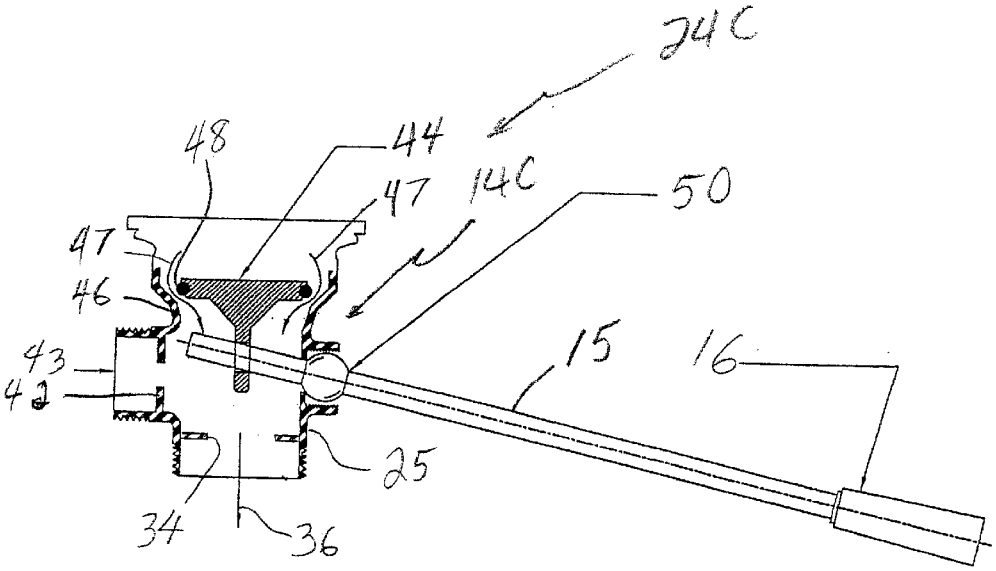
FIG. 7 is a cross-sectional view of another alternative preferred embodiment of the device of the present invention with the waste valve in the open position.

In accordance with the present invention, and as shown in FIGS. 5A, 6 and 7 for example, a fluid flow control device 24A, 24B and 24C, respectively, is provided as an integral component of the drainage system. Each fluid flow control device 24A, 24B, 24C can include a housing 25 that is disposed beneath a respective waste valve 14A, 14B and 14C. The housing 25 defines a continuation of the liquid flow path beneath the waste valve 14A, 14B or 14C. In each such embodiment, the housing 25 desirably is formed integrally as an extension to the outlet end of a respective waste valve 14A, 14B and 14C. The housing 25 and the body that defines the flow path of the discharge end of the waste valve 14A, 14B and 14C desirably constitute a unitary member that is molded as a single piece or as two halves that are permanently joined to become a unitary structure.

In accordance with the presently preferred embodiments of the invention, the housing 25 is provided with a flow control insert 26 that is configured and disposed to interrupt the flow of fluid leaving the waste valve 14A, 14B and 14C and before that flow reaches the grease interceptor 18. Both the housing 25 and insert 26 are desirably made as a unitary structure from cast metal, but can be formed of other materials that are rigid, sturdy and hold up well in corrosive environments. The thickness of the web forming the insert 26 desirably can be on the order of about one-quarter inch.

As shown in FIGS. 5A, 5B, 6 and 7 for example, the insert 26 has a flow control hole 34 defined through the insert 26. The flow control hole 34 through the insert 26 is desirably located through the center of the insert 26. The hole 34 is sized for a flow area according to the needs of the fluid flows that are anticipated in the drainage system in question. The size of the flow control hole 34 in the insert 26 can be predetermined so as to limit the amount of flow that will pass through the hole 34 of the insert 26 and accordingly eventually into the grease interceptor 18. The density and maximum depth of fluid in the sinks 10 determines the maximum pressure to be applied at the hole 34 in the insert 26, and thus limits the fluid flow through the hole 34 to a maximum amount. Different inserts 26 with holes 34 of different flow areas and shapes can be introduced into the flow control device 24 according to the environment in which the device 24 is to be used. The shape of the hole 34 in the insert 26 typically is circular, and the diameter of the insert 26 is smaller than the diameter of the housing 25. However, the shape of the hole 34 can for example be square, elliptical or another arcuate shape as well as shaped in the form of a polygon of 3 or more sides.

The waste valve 14A, 14B and 14C can be any of the conventional valves whereby movement of the handle 16 and shaft 15 selectively opens and closes the valve disposed beneath the sink 10. In the embodiment shown in FIG. 6 for example, the waste valve mechanism 14B is a poppet valve that is opened and closed according to a twisting manipulation of the handle 16 as schematically indicated by the arrow designated by the numeral 41. The distal end of the shaft 15 is rotatably received in a flange 42 disposed in the overflow branch 43 of the valve 14B. A plunger 44 is pivotally connected to an arcuate elbow 45 defined in the shaft 15 near the distal end thereof. The elbow 45 is disposed beneath the throat 46 of the valve 14B. In the view shown in FIG. 6, the handle 16 is twisted so that the plunger 44 is raised out of contact with the inner surface of the throat 46 of the valve 14B. As schematically indicated by the arrows designated by the numerals 47, this orientation of the plunger 42 allows liquid to flow around the circumference of the plunger 44 and past the O-ring 48 that is fixed around the outer circumference of the plunger 42. Rotation of the handle 16 from the position shown in FIG. 6 will lower the plunger 44 so that the O-ring 48 contacts the inner surface of the throat 46 of the valve 14B. Further rotation of the handle 16 and shaft 15 can be effected until the plunger 44 is locked into position in the throat 46 of the valve 14B.

As shown in FIG. 7 for example, the waste valve mechanism 14C can be a poppet valve that is operated by the lever action of the shaft 15 pivoting about a ball and compression seal assembly 50. In the view shown in FIG. 7, the opening in the flange 42 of the overflow branch 43 can be plugged. The plunger 44 is pivotally connected to the distal end of the shaft 15. Manipulation of the handle 16 works to move the shaft 15 and plunger 44. As shown in FIG. 7, a downward force on the handle 16 raises the plunger 44 upward to the open position that allows fluid to drain around the circumference of the plunger 44. If the handle 16 is positioned so that it is in a horizontal orientation (not shown), the plunger 44 is lowered to seat against the throat 46 of the valve 14C. When the plunger is so seated, the O-ring 48 that is fixed around the outer circumference of the plunger 44 engages the inner surface of the throat 46 and seals the valve 14C so as to prevent fluid from leaking past the O-ring 48.

Figure 3A:
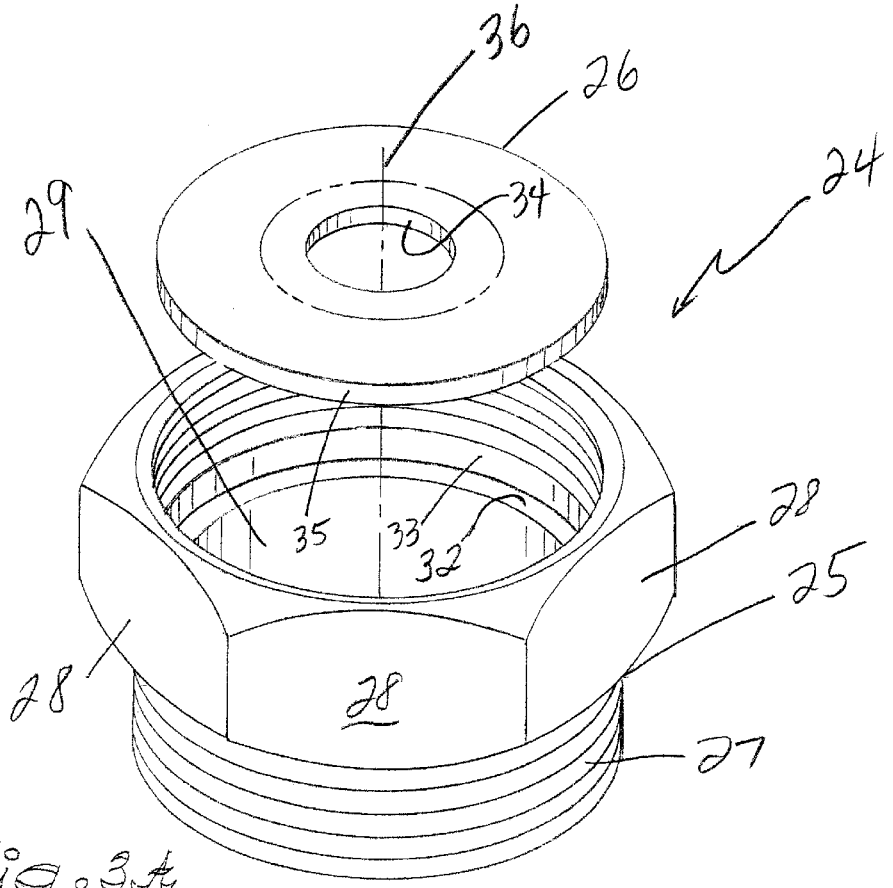
FIG. 3A is an elevated perspective view of an assembly view of the embodiment of FIG. 2.
Figure 3B:
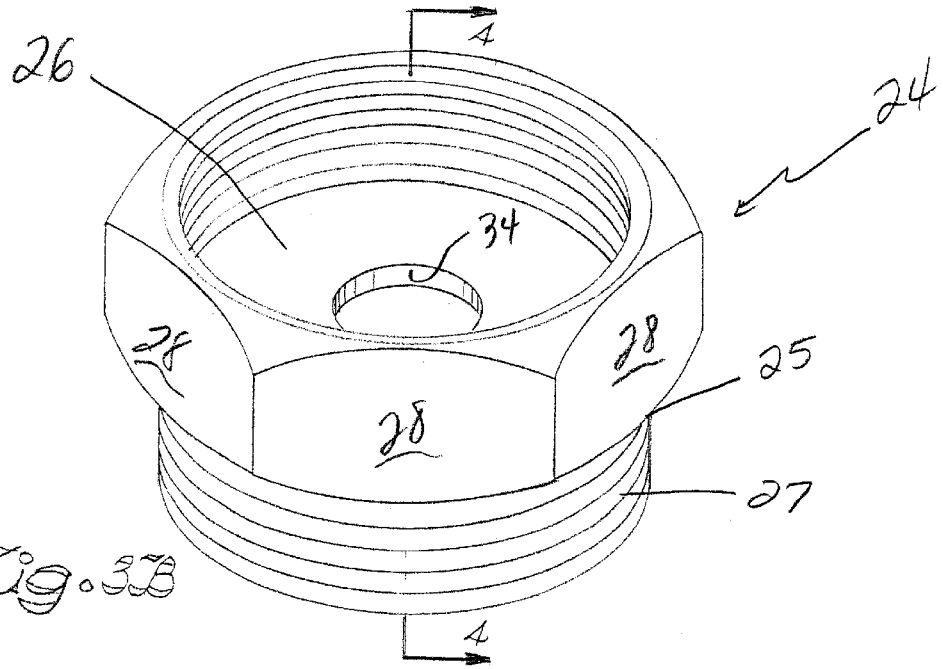
FIG. 3B is an elevated perspective view of the embodiment of FIG. 3A.
Figure 4:
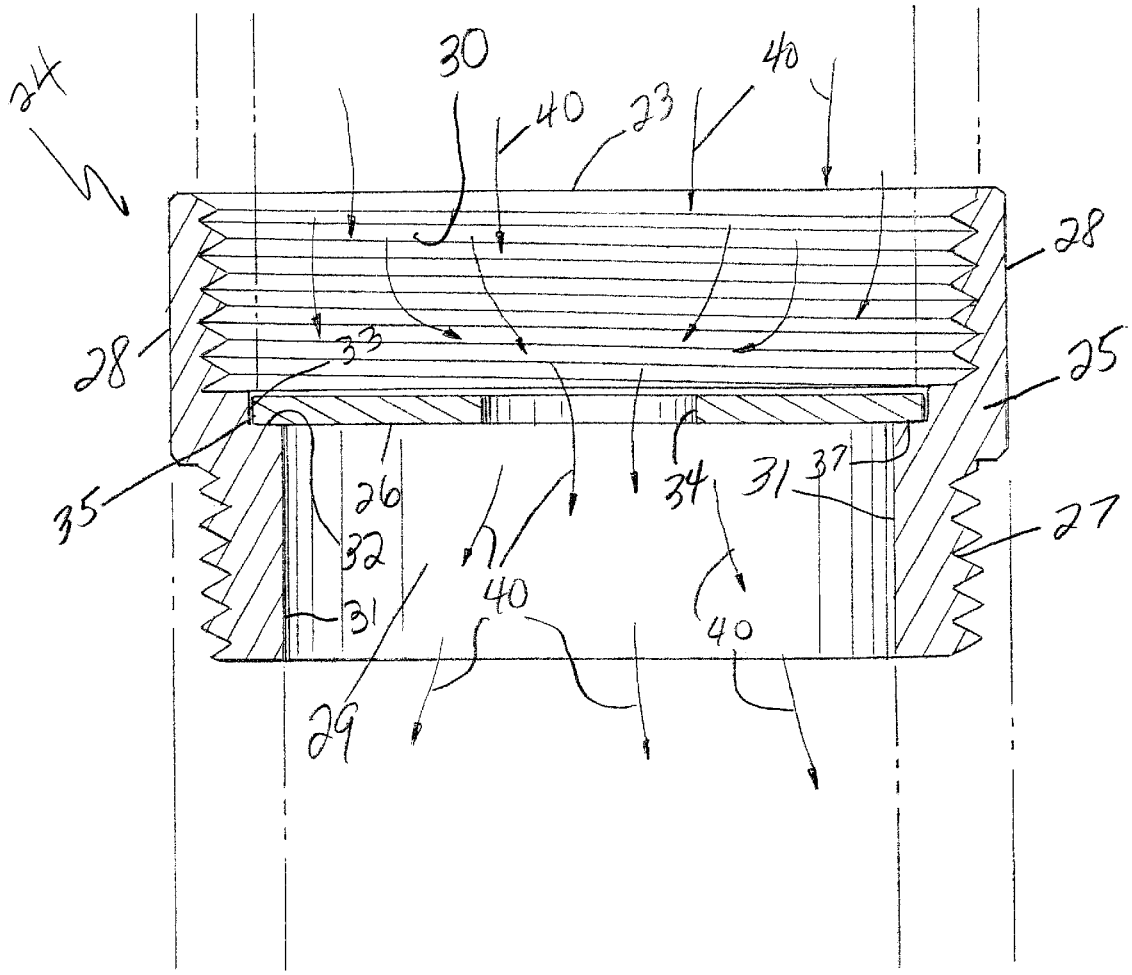
FIG. 4 is a cross-sectional view taken along the line of sight indicated by the arrows denoted 4—4 in FIG. 3B.

In one alternative embodiment shown in FIGS. 3B and 4 for example, a fluid flow control device 24 can include a housing 25 that is configured to receive and hold therein a removable flow control insert 26. Both the housing 25 and insert 26 are desirably made from stainless steel, but can be formed of other materials that are rigid, sturdy and hold up well in corrosive environments.

As shown in FIGS. 2, 3A, 3B and 4, the housing 25 is a generally hollow cylindrical member having external threading 27 on one end and a plurality of flat faces 28 forming a nut on the opposite end. As shown in FIG. 4, the housing 25 is hollow and defines an axial opening 29 that extends completely through the interior of the housing 25. One end of the interior surface of the housing 25 that defines the axial opening 29 can be configured as a threaded portion 30. The opposite end of the interior surface of the housing 25 that defines the axial opening 29 can be defined by a wall 31 that has a smaller diameter than the threaded portion 30 of the interior of the housing 25.

As shown in FIG. 3A, an annular ledge 32 is defined at an intermediate portion of the interior of the housing 25. As shown in FIG. 4, the ledge 32 can desirably be disposed about one half inch from the upstream edge 23 of housing 25. The ledge 32 can desirably be disposed at the interface between the end of the threaded portion 30 of the interior of the housing 25 and the portion defined by the wall 31 with the diameter that is narrower than the diameter of the threaded portion 30 in the interior of the housing 25. As shown in FIGS. 3A and 4, a ledge side wall 33 defines the outer periphery of the annular ledge 32. As shown in FIG. 4, the inner diameter of the ledge side wall 33 is smaller than the inner diameter of the threaded opening portion 30 of the housing 25 and larger than the inner diameter of the wall 31 defining the narrower diameter portion of the interior of the housing 25.

As shown in FIGS. 3A and 4, the removable flow control insert 26 is configured as a flat disk having an exterior edge 35 that is shaped to conform to the shape of the ledge side wall 33 of the housing 25. A thickness of about one-quarter inch for insert 26 is desirable. As shown in FIGS. 3B and 4 for example, the insert 26 is disposed into the threaded opening 30 of the housing 25. As shown in FIG. 4 for example, the outermost periphery 37 of one side of the insert 26 near the insert's outer edge 35 rests on the upper surface of the ledge 32 defined in the housing 25. The outer edge 35 of the insert 26 is disposed adjacent the ledge side wall 33 that defines the outer periphery of the ledge 32 defined in the housing 25.

As shown in FIGS. 3A, 3B and 4 for example, the flow control hole 34 is sized so that the cross-sectional area of the hole 34 is smaller than the cross-sectional area of the threaded portion 30 of the axial opening 29 of the housing 25. The shape of the hole 34 in the insert 26 typically is circular, and the diameter of the insert 26 is smaller than the diameter of the threaded portion 30 of the axial opening 29 of the housing 25. However, the shape of the hole 34 need not be circular and can for example be square, elliptical or another arcuate shape as well as shaped in the form of a polygon of 3 or more sides. As shown in FIG. 3A, the hole 34 in the insert and the axial opening 29 through the housing desirably are symmetrically disposed about a common axis 36 and are thus concentrically arranged about the central axis 36 of the device 24.

In operation, as schematically shown in FIG. 4, the insert 26 is disposed inside the axial opening 29 of the housing 25 and placed to rest on the ledge 32. As schematically shown in FIG. 2, the threaded exterior end 17 of the drainage valve 14 is threaded into the interior threaded end 30 of the housing 25. In this way, the end 17 of the drainage valve 14 presses the insert 26 against the ledge 32 of the housing 25 and holds the insert 26 tightly in place so that fluid only can pass through the insert's hole 34. A gasket or O-ring (not shown) can be disposed between the ledge 32 and the outer peripheral portion 37 of the insert 26 to ensure a fluid tight seal between the ledge 32 and the insert 26. The externally threaded portion 27 of the housing 25 can be screwed into one end of an elbow 21, which is shown in FIG. 1 for example. This externally threaded end 27 of the housing 25 also could be provided with threads on the interior surface, either in place of the external threads 27 or in addition to same.

As illustrated by the arrows designated 40 in FIG. 4, which are intended to represent the direction of the flow of fluid through the housing 25, the arrows 40 point in the direction of flow of fluid away from the sink 10 and toward the grease interceptor 18 (only shown in FIG. 1). The flow of fluid that passes through the drainage valve 14 enters the internally threaded portion 30 of the housing 25 and flows toward the ledge 32 in the middle of the housing 25 and constricts the flow of draining fluid so that it passes through the hole 34 in the center of the insert 26 before the fluid flow expands again into the downstream end of the housing 25 and into the drainage piping 21, 20, 22,19 that leads to the grease interceptor 18.

Replacing an insert 26 in the embodiment of FIG. 2 is a relatively simple matter. One merely disconnects the housing 25 from the drainage piping, removes the insert 26, replaces the insert 26 with another insert 26 having a hole 34 that is sized with the desired flow area, and reconnects the housing 25 into the drainage piping. Replacing an insert 26 in the embodiment of FIG. 5A is also a relatively simple matter. Instead of disconnecting the housing 25, one disconnects the entire unitary flow control device 24A and replaces it with another unitary flow control device 24A with the desired hole 34 in the insert 26.

While a preferred embodiment of the invention has been described using specific terms, such description is for illustrative purposes only, and it is to be understood that changes and variations may be made without departing from the spirit or scope of the following claims.

What is claimed is:

1. A flow control device for a sink that drains into a system that includes a grease interceptor, the flow control device comprising:

a waste valve, said valve including a body defining a drain flow path having an outlet end;

a hollow housing defining an interior and an exterior and an axial opening extending the length of said interior of said housing, said housing having a first end and a second end disposed opposite said first end, said first end of said housing being connected to said outlet end of said body of said waste valve, said housing defining a threaded surface beginning at said second end on at least one of said exterior and said interior of said housing; and a flow control insert, said insert being disposed across said interior of said housing to interrupt the flow of fluid leaving said waste valve, said insert defining a hole through said insert, said hole being sized such that the flow area through said hole is smaller than the flow area through said axial opening along said first end of said housing.

2. A device as in claim 1, wherein said insert and said housing form a unitary structure.

3. A device as in claim 1, wherein said insert, said housing and said body of said waste valve form a unitary structure.

4. A device as in claim 1, wherein the shape of said hole is circular.

5. A device as in claim 1, wherein said exterior of said housing near said second end is threaded.

6. A device as in claim 1, wherein said waste valve defines a ball valve.

7. A device as in claim 1, wherein said waste valve defines a lever-operated poppet valve.

8. A device as in claim 1, wherein said waste valve defines a rotary-twist operated poppet valve.

9. A device as in claim 1, wherein said insert is removable from said housing.

* * * * *

UNITED STATES PATENT AND TRADEMARK OFFICE

CERTIFICATE OF CORRECTION

PATENT NO. : 6,584,625 B2
DATED : July 1, 2003
INVENTOR(S) : Mark Weaver

It is certified that error appears in the above-identified patent and that said Letters Patent is hereby corrected as shown below:

Title page,
Item [75], add inventor: -- Keith Dacus, Simpsonville, SC (US) --.

Signed and Sealed this

Sixteenth Day of December, 2003

JAMES E. ROGAN
*Director of the United States Patent and Trademark Office*